US006722941B2

(12) United States Patent
Dowd et al.

(10) Patent No.: US 6,722,941 B2
(45) Date of Patent: Apr. 20, 2004

(54) TOY VEHICLE MAGNETIC COUPLER

(75) Inventors: Paul Dowd, Bronxville, NY (US); Mitchell P. Pomerantz, Highland Park, IL (US); Donald E. Toht, Highland Park, IL (US)

(73) Assignee: Learning Curve International Inc., Chicago, IL (US)

( * ) Notice: Subject to any disclaimer, the term of this patent is extended or adjusted under 35 U.S.C. 154(b) by 0 days.

(21) Appl. No.: 09/862,173

(22) Filed: May 21, 2001

(65) Prior Publication Data

US 2002/0061709 A1 May 23, 2002

Related U.S. Application Data

(63) Continuation-in-part of application No. 09/473,404, filed on Dec. 28, 1999, now abandoned.
(60) Provisional application No. 60/119,811, filed on Feb. 12, 1999.

(51) Int. Cl.[7] ..... A63H 17/00
(52) U.S. Cl. ..... 446/465; 446/137; 446/138; 446/431; 446/467
(58) Field of Search ..... 446/129, 137, 446/138, 139, 431, 444, 445, 465, 467, 448

(56) References Cited

U.S. PATENT DOCUMENTS

| | | | | |
|---|---|---|---|---|
| 2,126,585 A | * | 8/1938 | Stone | 411/455 |
| 2,500,180 A | | 3/1950 | Hubbell | |
| 2,607,157 A | * | 8/1952 | Smith | 213/75 TC |
| 2,645,878 A | | 7/1953 | Johnson | |
| 2,847,798 A | | 8/1958 | Orel | |
| 2,939,245 A | | 6/1960 | Orel | |
| 3,099,105 A | | 7/1963 | Martinez | |
| 3,303,606 A | | 2/1967 | Mann | |
| 3,330,066 A | * | 7/1967 | Crawford | 446/138 |
| 3,450,271 A | | 6/1969 | Bissett | |
| 3,711,991 A | | 1/1973 | Orfei et al. | |
| 3,840,127 A | | 10/1974 | Edwards et al. | |
| 3,850,310 A | | 11/1974 | Östhall | |
| 3,942,648 A | | 3/1976 | Edwards et al. | |
| 3,998,004 A | | 12/1976 | Ehrlich | |
| 5,048,704 A | | 9/1991 | Takahashi | |
| 5,427,561 A | | 6/1995 | Eichhorn et al. | |
| 5,681,202 A | * | 10/1997 | Sander | 446/138 |
| 5,775,525 A | | 7/1998 | Brill | |

FOREIGN PATENT DOCUMENTS

| | | |
|---|---|---|
| DE | 33 39 521 A1 | 5/1985 |
| EP | 0 312 683 A2 | 4/1989 |
| GB | 2 358 811 | 8/2001 |

* cited by examiner

*Primary Examiner*—Kurt Fernstrom
(74) *Attorney, Agent, or Firm*—Wallenstein, Wagner & Rockey, Ltd.

(57) ABSTRACT

A magnetic coupler for joining a first toy vehicle to a second toy vehicle is claimed. The magnetic coupler comprises a pair of spaced connectors. The connectors extend from an end wall of the first vehicle. A disk-shaped magnet is fixedly attached within a space formed between the pair of connectors. The disk-shaped magnet is mounted so that it is substantially perpendicular to the end wall of first toy vehicle.

24 Claims, 3 Drawing Sheets

TOY VEHICLE MAGNETIC COUPLER

RELATED APPLICATION

This is a continuation-in-part application of U.S. application Ser. No. 09/473,404 for "Toy Vehicle Magnetic Coupler", filed Dec. 28, 1999, now abandoned; which claims the benefit of Provisional Patent Application Ser. No. 60/119,811, filed Feb. 12, 1999.

TECHNICAL FIELD

The present invention relates generally to toy vehicles and, more particularly, to a magnetic coupler for joining a first toy vehicle to a second toy vehicle.

BACKGROUND

In the toy vehicle industry, small toy trains are often run on plastic or wooden tracks. These railway systems are designed to grow with the child. In other words, railway configurations can range from very simple ovals to complex systems incorporating bridges, buildings, tunnels, and towns. Many other accessories are available as well such as: toy figurines, bushes, shrubs, and trees to lend the system a realistic effect; playmats, playboards, and play tables on which to build a railway system; carry bags and boxes in which to store the railway system when not in use; and, storybooks, iron-ons, decals, and coloring books to further stimulate the child's imagination.

The railway configurations are built from individual track sections. The track sections range in size and shape. There are countless possibilities for individual track sections: some are straight; some feature switching mechanisms; some are curved; and, some are ascending for connection to another track positioned at a higher level.

One of the most important aspects of these railway systems is that the track sections be interchangeable. Accordingly, most track sections include male and/or female connectors at opposing ends. This allows the track sections to be connected end to end in a variety of configurations.

Normally, the toy vehicles in the railway system are connected by magnetic couplers. These magnetic couplers generally include a disk-shaped magnet which is mounted substantially parallel to an end wall of the toy vehicle chassis and joined to a rounded metallic connector. A first pole is substantially adjacent and perpendicular to the end wall of the toy vehicle. The second pole is opposite the first pole. The rounded metallic connector of one vehicle is joined to a rounded metallic connector of a second vehicle through the strength of the disk-shaped magnets. This arrangement is described in U.S. Pat. No. 3,850,310 issued to Östhall and U.S. Pat. No. 5,427,561 issued to Eichorn et al.

One of the problems that exists with the couplers described in Östhall and Eichorn et al. is their inability to hold the connection when the toy vehicles are climbing ascending track segments or traveling on curved track segments. The magnetic couplers of Östhall and Eichorn et al. have a tendency to separate from each other due to the increased stress on the connections which results from these situations. Another problem is that two toy vehicles can be connected in a single orientation.

U.S. Pat. No. 3,330,066 issued to Crawford and U.S. Pat. No. 5,681,202 issued to Sander describe magnetic couplers that are movably mounted to the toy vehicles. These magnetic couplers are undesirable because they can scratch the outer surfaces of the toy vehicles. Also, after continued use, these movably mounted couplers may fail, and replacements are difficult or impossible to retrofit within the toy vehicle.

U.S. Pat. No. 5,048,704 issued to Takahashi discloses a revolving magnet. The magnet of Takahashi has positive and negative poles that are oriented similar to discloses a magnet having poles oriented similarly to Östhall and Eichorn et al. Takahashi further discloses a magnetic coupler having a magnet that is capable of rotating about a central axis.

Therefore, an improved magnetic coupler for joining one or more toy vehicles together is needed.

SUMMARY OF THE INVENTION

The present invention provides a novel magnetic coupler for joining a first toy vehicle to a second toy vehicle. A magnetic coupler includes a first connector and a disk-shaped magnet for joining the first toy vehicle to the second toy vehicle.

The first connector has a substantially frustoconical shape. The first connector extends from an end wall of the first toy vehicle. The frustoconical connector also has an aperture for receiving a fastening element. The aperture is countersunk so that the head of the fastening element is flush with the frustoconical connector. The fastening element is used to mount the disk-shaped magnet on the frustoconical connector.

The disk-shaped magnet also has a fastener opening for receiving the fastener. The disk-shaped magnet is oriented so that is perpendicular to the end wall of the first vehicle.

Other advantages and aspects of the present invention will become apparent upon reading the following description of the drawings and detailed description of the invention.

DETAILED DESCRIPTION

Figure 1:
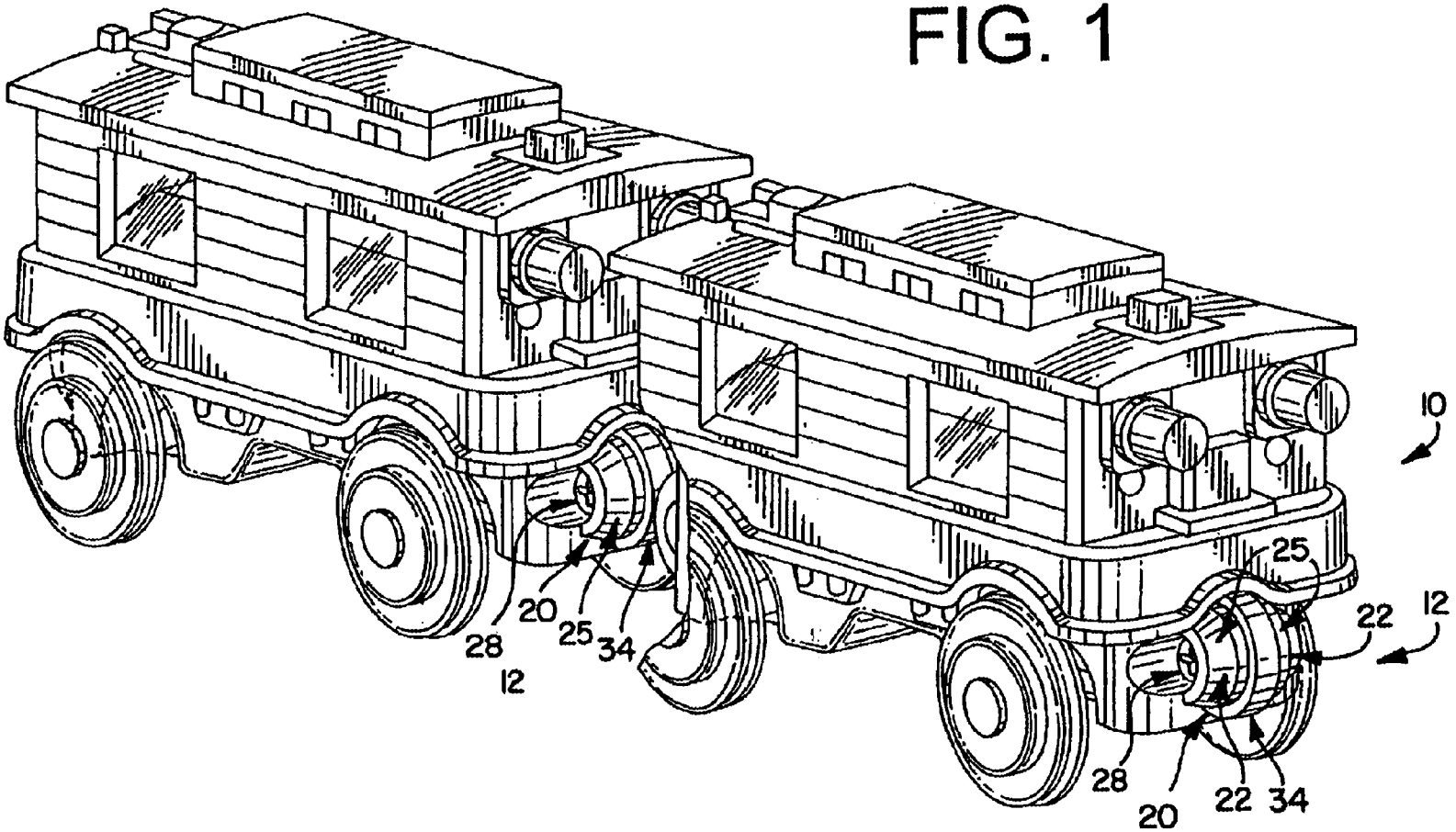
FIG. 1 is perspective view with a cut away view of a toy vehicle chassis having a magnetic coupler of the present invention.
Figure 2:
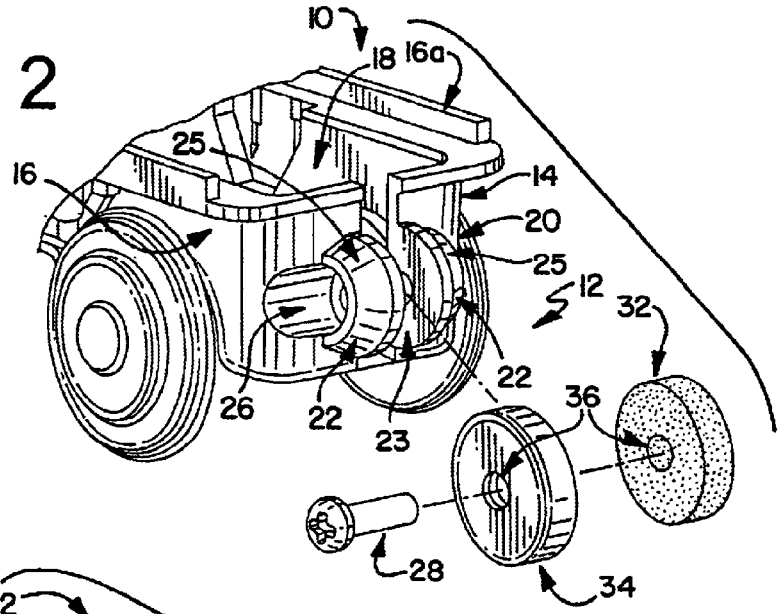
FIG. 2 is an exploded view of a vehicle chassis having a magnetic coupler of the present invention.

While this invention is susceptible of embodiments in many different forms, there are shown in the drawings and will herein be described in detail preferred embodiments of the invention with the understanding that the present disclosures are to be considered as exemplifications of the principles of the invention and are not intended to limit the broad aspect of the invention to the embodiments illustrated.

Referring to FIG. 1, a toy vehicle chassis 10 having a pair of magnetic couplers 12 of the present invention is illustrated. The chassis 10 comprises a pair of opposing end walls 14 joined by a pair of opposing side walls 16. The combination of the end walls 14 and the side walls 16 forms a housing 18 for receiving the body of a toy vehicle.

Magnet receivers 20 extend outwardly from the end walls 14. Each magnet receiver 20 comprises a pair of substantially frustoconical connectors 22. The frustoconical connectors 22 are separated by a space 23 which is wide enough to accept a magnet assembly 24. The frustoconical connectors 22 have annular metallic bands 25. Each frustoconical connector 22 also has an aperture 26 for receiving a fastening element 28, such as a bolt or a screw. One of the apertures 26 on each magnet receiver 20 is countersunk so that the head of the fastening element is flush with one of the frustoconical connectors 22. The fastening element 28 is used to mount the magnet assembly 24 within the space 23 formed by the frustoconical connectors 22. The frustoconical connectors 22 of a first vehicle couple to the frustoconical connectors 22 of a second vehicle to join the vehicles together.

Each magnet assembly 24 includes a disk-shaped magnet 32, a magnet cover 34, and the fastening element 28. Each magnet 32 and each magnet cover 34 have a fastener opening 36 for receiving the fastener 28. In operation, the disk-shaped magnets 32 fit within the magnet covers 34. The disk-shaped magnet 32 and the magnet covers 34 are oriented so that they are perpendicular to the end walls 14. This orientation is particularly successful at coupling toy vehicles through ascending track portions. The disk-shaped magnets 32 may cooperate with the metallic bands 25 to create a coupling surface. This coupling surface includes a greater surface area than conventional magnetic couplers for coupling two toy vehicles together. Thus, two toy vehicles will remain magnetically coupled through curved track segments and ascending track segments without the use of a movably mounted magnetic coupler.

Stated another way, each magnet 32 has a continuous sidewall, a first end, a second end, a positive pole and a negative pole. The continuous sidewall joins the first and second ends so that the first and second ends are in opposing relationship, and the positive pole and the negative pole are located along the first and second ends of the magnet, respectively. The magnet 32 is mounted within the magnet receiver 20 so that the first and second ends of the magnet 32 are substantially perpendicular to the end wall of the toy vehicle, and the positive and negative poles are substantially horizontally aligned with the end wall of the toy vehicle.

Furthermore, because the positive and negative poles of the magnet are substantially horizontally aligned with the rear of the vehicle, a pair of toy vehicles having similar magnetic couplers 12 of the present invention can be joined in any orientation. Generally, magnetic couplers are mounted with the poles perpendicular to the rear of the vehicle; thus, coupling of the toy vehicles is limited to a single orientation. In other words, the magnetic couplers 12 of the present invention are particularly advantageous because they allow the user to couple two toy vehicles regardless of the orientation of the toy vehicles.

Figure 3:
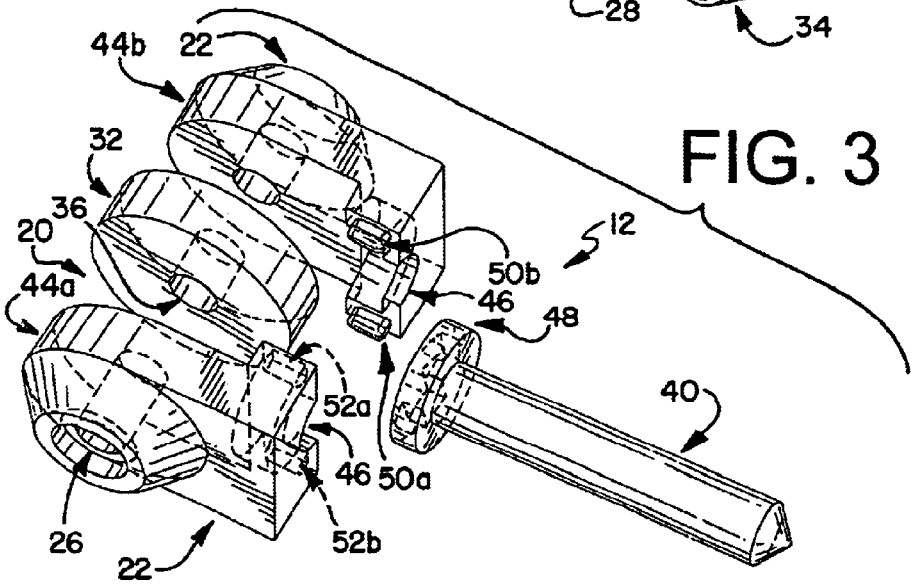
FIG. 3 is an exploded, perspective view of a magnetic coupler of the present invention.

Referring to FIG. 3, an embodiment of the magnetic coupler 12 is illustrated. The magnetic coupler 12 further includes a connecting pin 40. The connecting pin 40 is generally an elongated member which extends outwardly from magnet receiver 20 on an opposite side of the magnetic receiver 20 as the frustoconical connectors 22. The connecting pin 40 frictionally engages a portion of the toy vehicle chassis 10 to fix the magnetic coupler 12 to the chassis 10.

In this embodiment, the magnet coupler 12 includes a separable frustoconical connector assembly. The separable frustoconical connector assembly includes first and second portions 44*a*, 44*b*. Each portion 44*a*, 44*b* includes an arcuate receiver 46 for accepting a head portion 48 of the connecting pin 40. The first and second portions 44*a*, 44*b* are press fit together as a pair of bosses 50*a*, 50*b*, engage a pair of recesses 52*a*, 52*b*. The connecting pin 40 is held in place between the acuate receivers 46.

Figure 4:
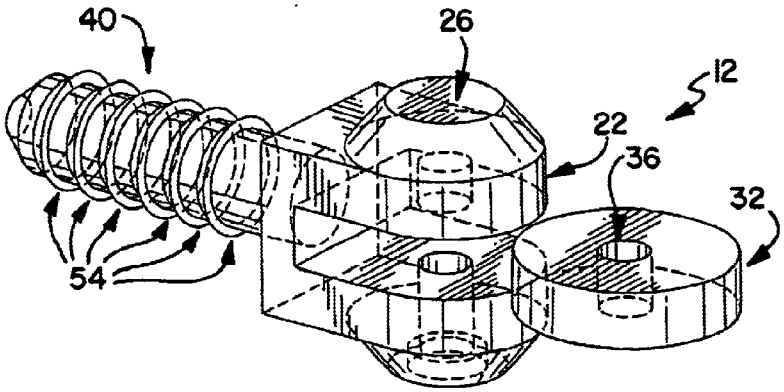
FIG. 4 is an exploded, perspective view of a magnetic coupler of the present invention.

FIG. 4 illustrates another embodiment of the magnetic coupler 12. In this embodiment, the magnet receiver 12 has a unibody construction. The connecting pin 40 includes a plurality of ribs 54 for frictionally engaging a portion of the vehicle chassis 10 to fixedly secure the magnetic coupler 12 to the toy vehicle.

Figure 5:
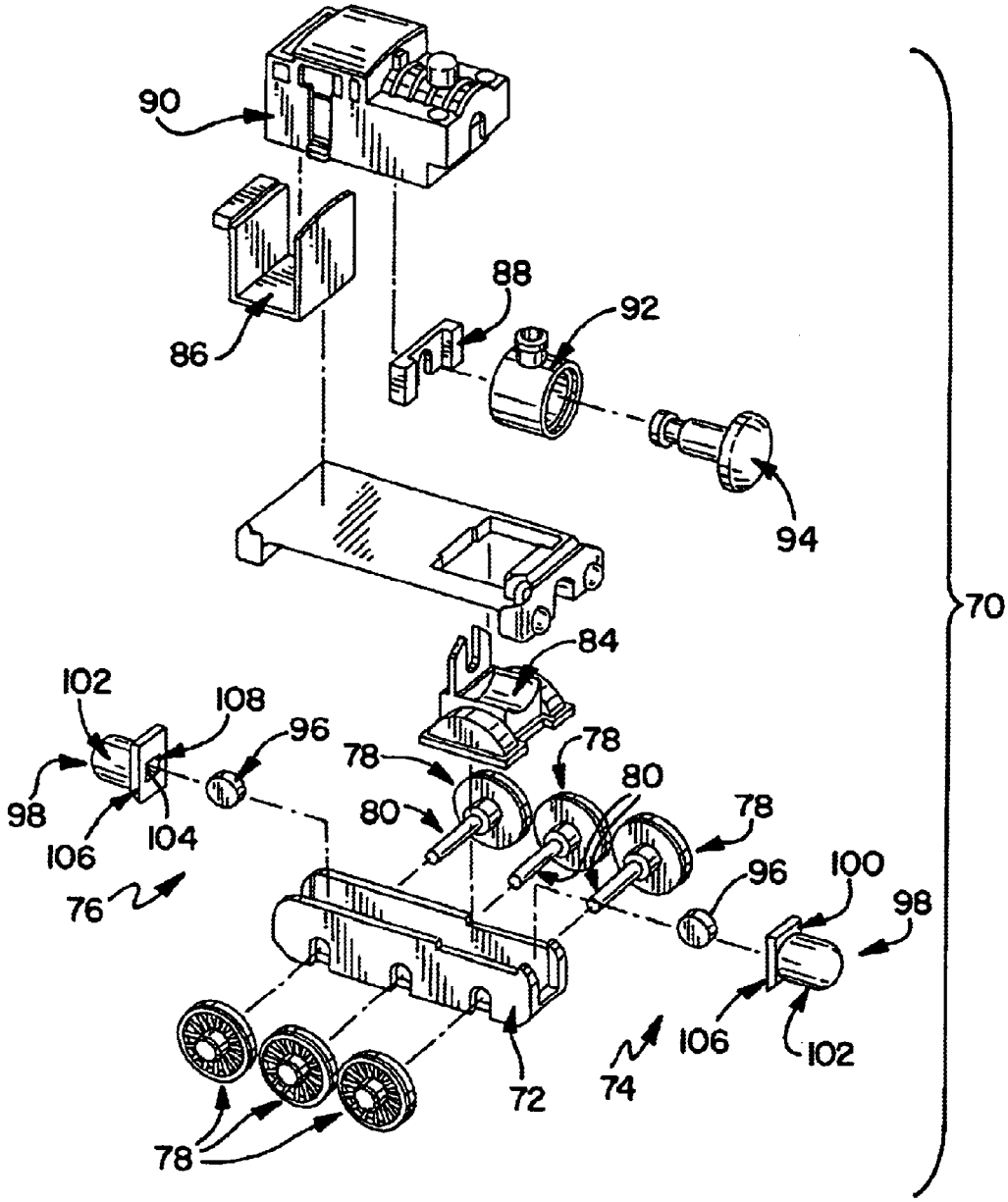
FIG. 5 is an exploded, perspective view of a magnetic coupler of the present invention.

FIG. 5 illustrates yet another embodiment of the present invention. Again, this embodiment, provides a means for coupling first and second toy vehicles in two orientations rather than one. This embodiment is further advantageous because it allows for coupling in two orientations without external moving parts, pinch points, and the like. It is also simple to assemble because the components snap together and does not require additional tools to assemble.

FIG. 5 is an exploded, perspective view of a toy vehicle 70 comprising a chassis 72 for supporting a wheel assembly, a body assembly, and first and second magnetic couplers 74, 76. The toy vehicle 70 includes a simple snap together design that allows the components of the toy vehicle 70 to be joined without the use of additional fasteners or adhesives.

The wheel assembly comprises pairs of wheels 78 joined by axles 80. The axles 80 pass through openings in the chassis 72. The openings are large enough to allow the axles to rotate within the chassis 72.

The body assembly comprises a wheel cover 82, a bumper 84, an internal support 86, an internal keeper 88, and external vehicle body members 90, 92, 94 which simulate a locomotive body. The body assembly components snap together to form the finished body assembly. In the embodiment illustrated a simulated locomotive body is provided; however, it should be noted that the simulated locomotive body is provided for illustrative purposes only, and any toy vehicle body can be provided without departing from the spirit of the invention.

Each of the magnetic couplers 74, 76 of this embodiment comprise a magnet 96 and a magnet cover 98. The magnets 96 are conventional disk-shaped magnets having a continuous sidewall, a first end, a second end, a positive pole and a negative pole. The continuous sidewall joins the first and second ends so that first and second ends are in opposing relationship. The positive pole and the negative pole extend from the first and second ends of the magnet 96, respectively.

The magnet covers 98 are generally produced from a polymeric or metallic material, but preferably from a metallic material. The magnet covers comprise a lip portion 100 integral with a magnet housing 102. The magnet housing 102 defines a chamber 104 for receiving the magnet 96. The chamber 104 may be large enough in relation to the size of the magnet 96 to allow the magnet 96 to rotate freely or float within the housing 102. Alternatively, the chamber 104 may be sized to support the magnet 96 in an orientation wherein the positive and negative poles of the magnet 96 are substantially horizontally aligned with the rear of the vehicle, similar to the embodiment of FIG. 1.

The lip portion 100 has a peripheral edge 106 that is adapted to mate with portions of the chassis 72 and the bumper 84 to join the magnetic couplers 74, 76 to the chassis 72. The lip portion 100 further defines an opening 108 for receiving the magnet 96. The opening 108 provides an entrance to the chamber 104.

While specific embodiments have been illustrated and described, numerous modifications are possible without departing from the spirit of the invention, and the scope of protection is only limited by the scope of the accompanying claims.

What is claimed is:

1. A magnetic coupler for joining a first toy vehicle to a second toy vehicle, the magnetic coupler comprising:

a toy vehicle comprising at least one end wall;

a magnet receiver joined to the end wall of the toy vehicle; and a magnet having a continuous sidewall, a first end, a second end, a positive pole and a negative pole, the continuous sidewall joining the first and second ends wherein the first and second ends are in opposing relationship, and the positive pole and the negative pole are located along the first and second ends of the magnet, respectively, the magnet located within the magnet receiver so that the first and second ends of the magnet are substantially perpendicular to the end wall of the toy vehicle, and the positive and negative poles are substantially horizontally aligned with the end wall of the toy vehicle.

2. The magnetic coupler of claim 1 wherein the magnet receiver comprises first and second connectors.

3. The magnetic coupler of claim 2 wherein the second connector is spaced from the first connector so that the magnet is positioned between the first and second connectors.

4. The magnetic coupler of claim 3 wherein the first and second connectors each have a frustoconical shape.

5. The magnetic coupler of claim 1 wherein the magnet is fit within a magnet cover.

6. The magnetic coupler of claim 1 further comprising a connection pin for joining the magnet receiver to the end wall of the toy vehicle.

7. The magnetic coupler of claim 6 wherein the connecting pin includes a rib for frictionally engaging a portion of the toy vehicle.

8. The magnetic coupler of claim 1 wherein the magnet receiver comprises a cover having an internal chamber adapted for receiving the magnet and an external connecting surface.

9. The magnetic coupler of claim 1 wherein the external coupling surface is produced from a metallic material.

10. The magnetic coupler of claim 8 wherein the external connecting surface of the cover is a dome-shaped protrusion extending lengthwise from the end wall.

11. The magnetic coupler of claim 8 wherein the cover includes a lip portion and the end wall of the toy vehicle includes a slot for receiving the lip portion of the cover.

12. A magnetic coupler for joining a first toy vehicle to a second toy vehicle, the magnetic coupler comprising:

a toy vehicle comprising at least one end wall;

a first substantially frustoconical connector having a first annular metallic band fixedly attached to an outer surface and extending from the end wall of the toy vehicle;

a second substantially frustoconical connector having a second annular metallic band fixed attached to an outer surface and extending from the end wall of the toy vehicle spaced from the first substantially frustoconical connector and in parallel relationship to the first substantially frustoconical connector; and a disk-shaped magnet positioned between the first and second substantially frustoconical connectors and fixedly attached to the first frustoconical connector, the disk-shaped magnet oriented so that it is substantially perpendicular the end wall of the toy vehicle.

13. The magnetic coupler of claim 12 wherein the disk-shaped magnet is positioned within a magnet cover.

14. A magnetic coupler for joining a first toy vehicle to a second toy vehicle, the magnetic coupler comprising:

a magnet;

a magnet receiver comprising a connector pin for fixing the magnetic coupler to a toy vehicle, a first portion having a first connector pin receiver, and a second portion having a second connector pin receiver, the first portion fixedly connected to the second portion, and the first connector pin receiver and the second connector pin receiver are adapted for cooperatively receiving a portion of the connector pin, wherein the magnet is mounted between the first and second portion.

15. The magnetic coupler of claim 14 wherein the first portion includes a boss, and the second portion includes a recess adapted for receiving the boss wherein the boss is press fit within the recess to fixedly connect the first and second portions.

16. The magnetic coupler of claim 14 wherein the magnet has a continuous sidewall, a first end, a second end, a positive pole and a negative pole, the continuous sidewall joining the first and second ends wherein the first and second ends are in opposing relationship, and the positive pole and the negative pole are located along the first and second ends of the magnet respectively, the magnet and the magnet cover are mounted within the magnet receiver such that the first and second ends of the magnet are substantially perpendicular to the end wall of the first toy vehicle, and the positive and negative poles are substantially horizontally aligned with the end wall of the first toy vehicle.

17. The magnetic coupler of claim 14 wherein the magnet is disk-shaped.

18. The magnetic coupler of claim 14 wherein the connector pin includes a ribbed portion for frictionally engaging, with press fit, a portion of the first toy vehicle.

19. The magnetic coupler of claim 18 wherein the ribbed portion comprises a plurality of ribs.

20. A toy vehicle comprising:

an end wall;

a magnet having a sidewall, a first end, a second end, a positive pole and a negative pole, the sidewall joining the first and second ends wherein the first and second ends are in opposing relationship, and the positive pole and the negative pole are located along the first and second ends of the magnet, respectively; and a magnet cover extending from the end wall having an internal chamber and an external connecting surface, the internal chamber adapted for receiving and enclosing the magnet so that the positive and negative poles are substantially horizontally aligned with the end wall of the toy vehicle.

21. The toy vehicle of claim 20 wherein the magnet is mounted within the magnet cover so that the first and second ends of the magnet are substantially perpendicular to the end wall of the toy vehicle, and the positive and negative poles are substantially horizontally aligned with the end wall of the toy vehicle.

22. The toy vehicle of claim 20 wherein the external connecting surface of the magnet cover is a dome-shaped protrusion extending lengthwise from the end wall.

23. The toy vehicle of claim 20 wherein the magnet cover is produced from a metallic material.

24. The toy vehicle of claim 20 wherein the magnet cover includes a lip portion and the end wall of the toy vehicle includes a slot for receiving the lip portion of the magnet cover.

* * * * *